US009371206B2

(12) United States Patent
Ottmer

(10) Patent No.: US 9,371,206 B2
(45) Date of Patent: Jun. 21, 2016

(54) HORIZONTAL STRIP ACCUMULATOR WITH TELESCOPING OF STRIP SUPPORT ROLL CARRIAGES AND PASSIVE LOCATION SYSTEMS THEREOF

(75) Inventor: Thomas Ottmer, Neupre (BE)

(73) Assignee: Cockerill Maintenance & Ingénierie S.A., Seraing (BE)

( * ) Notice: Subject to any disclaimer, the term of this patent is extended or adjusted under 35 U.S.C. 154(b) by 303 days.

(21) Appl. No.: 13/996,329

(22) PCT Filed: Dec. 20, 2011

(86) PCT No.: PCT/EP2011/073357

§ 371 (c)(1),
(2), (4) Date: Aug. 6, 2013

(87) PCT Pub. No.: WO2012/084913

PCT Pub. Date: Jun. 28, 2012

(65) Prior Publication Data

US 2013/0306698 A1 Nov. 21, 2013

(30) Foreign Application Priority Data

Dec. 23, 2010 (EP) ..... 10196824

(51) Int. Cl.
*B65H 23/34* (2006.01)
*B65H 20/34* (2006.01)
(Continued)

(52) U.S. Cl.
CPC ..... *B65H 20/34* (2013.01); *B21C 49/00* (2013.01); *B65H 20/32* (2013.01); *B65H 2408/21* (2013.01); *B65H 2701/173* (2013.01)

(58) Field of Classification Search
CPC .. B65H 23/042; B65H 23/044; B65H 23/046; B65H 23/048; B65H 20/24; B65H 20/34; B65H 20/32; B65H 2408/21; B65H 2408/212; B65H 2408/213; B65H 2408/214; B21C 49/00
See application file for complete search history.

(56) References Cited

U.S. PATENT DOCUMENTS 2,499,750 A 3/1950 Hotchkiss, Sr.
5,769,302 A 6/1998 Richert et al.
(Continued)

FOREIGN PATENT DOCUMENTS

AT 299103 B 6/1972
CN 1082497 A 2/1994
(Continued)

OTHER PUBLICATIONS

Machine Translation of FR 2698803, Nov. 1994, retrieved Aug. 23, 2015.*

*Primary Examiner* — Michael McCullough
(74) *Attorney, Agent, or Firm* — Reinhart Boerner Van Deuren P.C.

(57) ABSTRACT

The present invention relates to a horizontal strip accumulator in a continuous processing strip line, comprising a looping carriage riding on a pair of external rails (6) and a plurality of adjacent strip supporting roll carriages (1) riding on the same external rails (6) to support the strip (10) between the looping carriage and a strip feeding location, wherein the strip supporting carriages (1) have a horizontal triangular lower part (2) and a vertical framework (3), the triangular lower part (2) having an open transverse base (15) opposite to an apex (14), to allow the telescoping of the strip supporting carriages (1) in the internal triangular space between the open base (15) and the two other triangular sides rejoining at the opposite apex (14).

11 Claims, 4 Drawing Sheets

(51) Int. Cl.
*B21C 49/00* (2006.01)
*B65H 20/32* (2006.01)

(56) References Cited

U.S. PATENT DOCUMENTS

| | | | | |
|---|---|---|---|---|
| 6,202,912 | B1 | 3/2001 | Perret et al. | |
| 6,516,987 | B1 | 2/2003 | Sohl et al. | |
| 7,963,229 | B2 * | 6/2011 | Timan | B61B 13/04 104/118 |

FOREIGN PATENT DOCUMENTS

| | | | |
|---|---|---|---|
| DE | 1953169 | A1 | 5/1971 |
| DE | 3925193 | A1 | 2/1991 |
| DE | 10104093 | A1 | 8/2002 |
| DE | 10314982 | A1 | 10/2004 |
| DE | 102004042594 | A1 | 3/2006 |
| DE | 102004042595 | A1 | 3/2006 |
| EP | 0110864 | A1 | 6/1984 |
| EP | 0 328 557 | B1 | 3/1992 |
| EP | 2002906 | A1 | 12/2008 |
| FR | 2698803 | A1 | 6/1994 |
| FR | 2778350 | A1 | 11/1999 |
| GB | 2 154 972 | A | 9/1985 |
| JP | S5657507 | A | 5/1981 |
| JP | S58145511 | A | 8/1983 |
| JP | H03-91118 | U | 9/1991 |
| JP | H08141639 | A | 6/1996 |

* cited by examiner

HORIZONTAL STRIP ACCUMULATOR WITH TELESCOPING OF STRIP SUPPORT ROLL CARRIAGES AND PASSIVE LOCATION SYSTEMS THEREOF

FIELD OF THE INVENTION

The present invention relates to horizontal accumulators used for storing and feeding metal strips to assure continuous operation in processing lines. Such accumulators comprise a looping carriage on rails for hairpin looping of the strip with two or more superposed strands as well as a plurality of roll carriages for strip support.

PRIOR ART AND TECHNICAL PROBLEM

Numerous inventions relate to an improvement of the horizontal strip accumulator as used in continuous processing lines as for steel strips. Classical horizontal strip accumulators comprise a looping carriage moving on rails, which enlarges or diminishes the strip loops in order to maintain a constant strip speed in one processing section, while the adjacent processing section runs for a certain time at a different speed. However, the plurality of horizontal strip loops have to be supported in order to limit their catenary sag and to avoid that the strip strands are rubbing on each other. This is normally done by strip supporting rolls which are put in the loops by a specific mechanism at a certain inter-distance. When the looping carriage passes at the location of these rolls, the latter have to be withdrawn from the carriage path.

This first system needs a complicated gate mechanism for putting the strip supporting rolls into and out of the loops. These gate systems can lead to problems such as uneven wear of the strip supporting rolls or possible collision with the looping carriage in case of malfunction, for example due to a spring break. There are several patents, like EP 2 002 906 A1, U.S. Pat. No. 6,516,987 B1, FR 2 778 350 A1, JP 8 141639 A or DE 10 314982 A1, covering this principle.

Another technical possibility is that a series of dedicated strip supporting roll carriages follow the looping carriage and are kept at a certain inter-distance within the loops to support the strip strands. This second solution has the disadvantage that a portion of the space for the looping capacity is used by the strip supporting roll carriages as it is seen in DE 3925193 A1.

Another invention depicted in DE 10 2004 042 595 A1, or in DE 10 2004 042 594 A1, using the second technique, reduces however this disadvantage by a telescopic design of the different strip supporting carriages, which travel on the same rails as the looping carriage. This allows an erection on a flat ground floor, but with the specification that two pairs of rails are needed, wherein the inner pair shall be at an inter-distance of 80 to 90% of the outer one. In this system there is no anti-tilting-over device of the strip supporting carriages.

Moreover, numerous patents describe several positioning systems for the strip supporting carriages, which follow the looping carriage so that the variable distance between the looping carriage and the first strip supporting carriage is always the same as the inter-distance between the strip supporting carriages (see DE 1 953 169 A1, AT 299 103, EP 0 110 864 A1, DE 10 2004 042 595 A1, DE 10 2004 042 594 A1, DE 101 04 093 A1 or U.S. Pat. No. 5,769,302 A). Other patents request complicated drive systems for the precise location of the strip supporting carriages along the loops (see DE 101 04 093 A1 or U.S. Pat. No. 5,769,302 A).

There is also a variety of patents disclosing hooking and unhooking of the trailer. In JP 56 057507 A, CN 1082497 A, GB 2 154 972 A and U.S. Pat. No. 2,499,750 A, there are automatic coupling systems, but they do not provide for automatic uncoupling. In JP 58 145511 A, electric power is requested. EP 328 557 B1 claims coupling and uncoupling by use of a complicated system.

A design to hook a strip supporting roll carriage to the next one as well as to the looping car and to unhook the strip supporting roll carriage at dedicated positions with a locking mechanism is known. This design has the disadvantage that it cannot be erected directly on flat ground and the strip supporting roll carriage length reduces the space left for looping capacity. Furthermore the position locking system does not lock the backwards movement of the strip support roll carriage right after unhooking, but only when the preceding carriage is already a certain length further in its movement.

Use of accumulators with strip supporting roll carriages allows to avoid the problems related to mechanically complicated gate removable systems. They are reliable and allow a good separation and support of the different strip strands in the horizontal accumulator. The function of the supporting carriages is assured by a precise location of the carriages. The strip supporting carriages simply roll on the rails of the looping carriage. At last maintenance is easy.

Use of accumulators with strip supporting roll carriages show however a number of drawbacks. Usually the hooking and unhooking system of the strip supporting carriages is complicated (adjustment is needed in order to unhook on both sides at the same time). To reduce a possible tilting-over torque of the strip supporting carriages, the rails should be placed at half height, which needs additional structure and further limitation to light systems. Moreover the horizontal extent of the strip supporting carriages implies that 10-15% of the accumulator capacity is occupied by these.

The problem to be solved is related to the engineering of a horizontal strip accumulator, with a looping carriage and strip supporting roll carriage system, that requires minimum space on the ground regarding to the looping capacity. The strip supporting roll carriages shall ride on the looping carriage rails on flat ground in order to allow not only accumulation of light but also of heavy strips. The strip supporting carriages shall be placed within the strip loop in their specified location and secured against undesired displacement. Furthermore they have to be secured against tilting-over and misalignment even under adverse conditions by a system, which will not act as a break to the carriage movement. The location and securing system of the strip supporting roll carriages shall advantageously be entirely passive. Moreover the strip supporting roll carriages shall be driven only via the forces acting on the looping carriage.

AIMS OF THE INVENTION

The present invention aims to provide a horizontal strip accumulator with some improvements compared to systems of prior art.

Particularly the invention aims at providing a horizontal accumulator that can be erected without further structure or framework on flat ground.

An additional goal of the invention is to provide a high looping capacity and a security against tilting-over or misalignment of the strip supporting carriages.

SUMMARY OF THE INVENTION

The present invention relates to a horizontal strip accumulator in a continuous processing strip line, comprising a looping carriage riding on a pair of external rails, which enlarges or diminishes strip loops in order to maintain a constant strip speed in a processing section, while an adjacent processing section runs for a certain time at a different speed, and a plurality of adjacent strip supporting roll carriages riding on the same external rails to support the strip between the looping carriage and a strip feeding location, characterised in that the strip supporting carriages have a horizontal triangular lower part and a vertical framework, the triangular lower part having an open transverse base opposite to an apex, to allow the telescoping of the strip supporting carriages in the internal triangular space between the open base and the two other triangular sides rejoining at the opposite apex.

According to different or preferred embodiments of the present invention, the accumulator of the invention is further limited by one or a suitable combination of the following characteristics:

- the apex of the triangular lower part is provided with means for guided riding of the strip supporting carriage within an internal rail, located between the two external rails;
- said guiding means comprise anti-tilting-over wheels and guiding cam rollers;
- the internal rail is a "I"-profile or girder and the guided riding of the strip supporting carriage is arranged by means of four anti-tilting-over wheels rolling on the internal side of the flanges of the "I"-profile and two guiding cam rollers rolling on each side of the web of the "I"-profile;
- the vertical framework is provided with strip supporting rolls at different heights and with openings to allow the passage of the strip;
- the vertical framework is provided with buffers in order to soften the contact with the adjacent strip supporting carriage;
- the vertical framework comprises two vertical profiles connected by rigid link not hindering the strip loops;
- the triangular lower part of the strip supporting carriages is riding and guided underneath a plurality of stationary strip supporting rolls for the bottom strand of the strip;
- the stationary supporting rolls are fixed on the girder or "I"-profile;
- the accumulator comprises passive means respectively for:
  - automatically and progressively unhooking the strip supporting carriages between themselves and from the forwards-moving looping carriage, when the loops are enlarged up to a maximum strip loop length corresponding to the sum of fixed inter-distances respectively between the looping carriage and its adjacent strip supporting carriage and between all the adjacent strip supporting carriages; the unhooked strip supporting carriages being stopped and locked at a determined location corresponding to said fixed inter-distances, thanks to a stationary locking system;
  - automatically and progressively freeing the unhooked strip supporting carriages from their locked location when the loops are reduced and the looping carriage moving backwards, so that the loop length is lower than the maximum strip loop length,
  - automatically and progressively hooking the strip supporting carriages between themselves and to the looping carriage, after the strip supporting carriages have been progressively freed from their locked location;
- the passive means comprise a stationary cam for raising a hook of a strip supporting carriage from its hooking position on the adjacent strip supporting carriage or on the looping carriage and a stationary locking system, comprising, integral with a same arm, a lock to maintain the unhooked strip supporting carriage at said determined location and a lever cooperating with a serrated cam on the strip supporting carriage, so that, when the looping carriage and possibly the already hooked strip supporting carriages thereto move backwards, the cam raises the lever and its corresponding arm, which suppresses the connection between the lock and the hook of the strip supporting carriage and frees the backwards movement of the formerly locked unhooked strip supporting carriage, the freed strip supporting carriage being able to hook to the incoming carriage in the backwards direction, thanks to the gravity putting the hook in a hook eye on the adjacent strip supporting carriage;
- the passive means comprise a stationary buffer or jack provided to soften the stop of the forwards moving strip supporting carriage at its determined locking location;
- the continuous strip processing line uses metal or textile or plastic strip.

SHORT DESCRIPTION OF THE DRAWINGS

DETAILED DESCRIPTION OF THE INVENTION AND PREFERRED EMBODIMENTS

Figure 1:
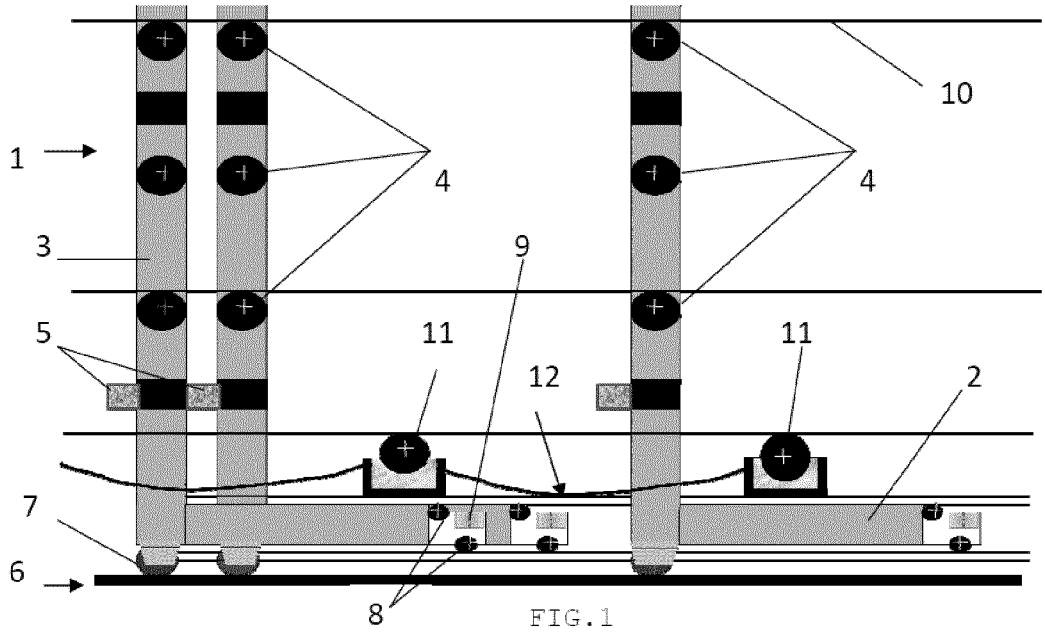
FIG. 1 represents an elevation view of a horizontal accumulator section according to the present invention.
Figure 2:
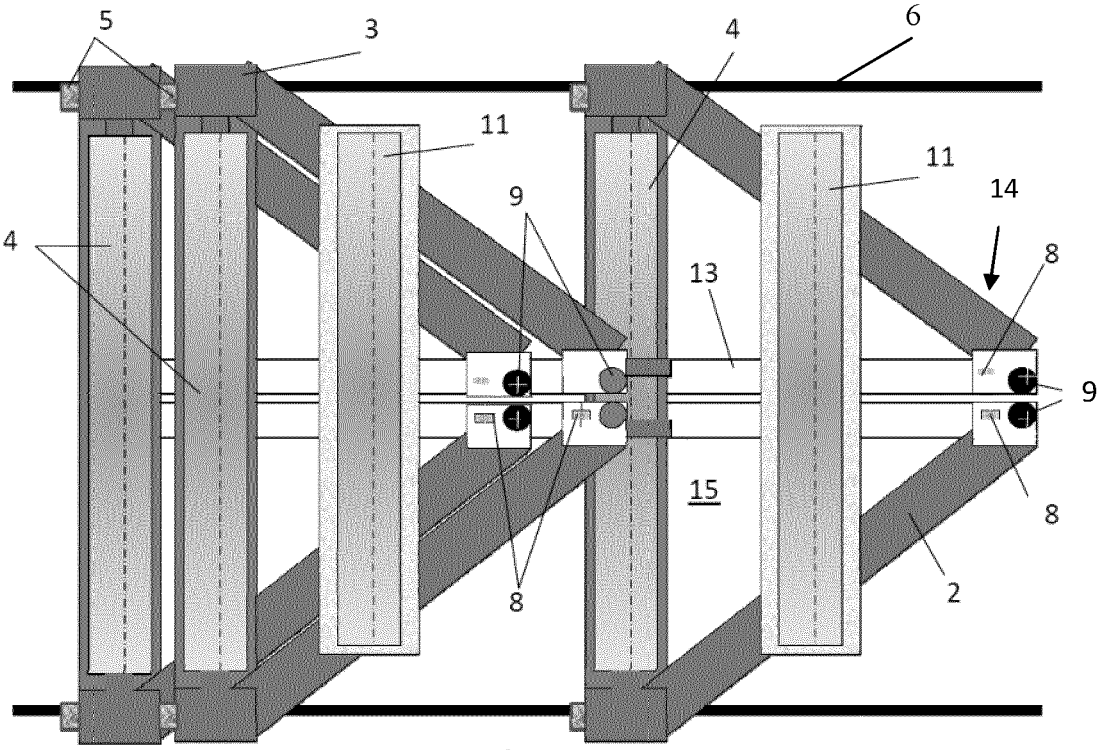
FIG. 2 represents a plan view of the accumulator section depicted in FIG. 1.
Figure 3:
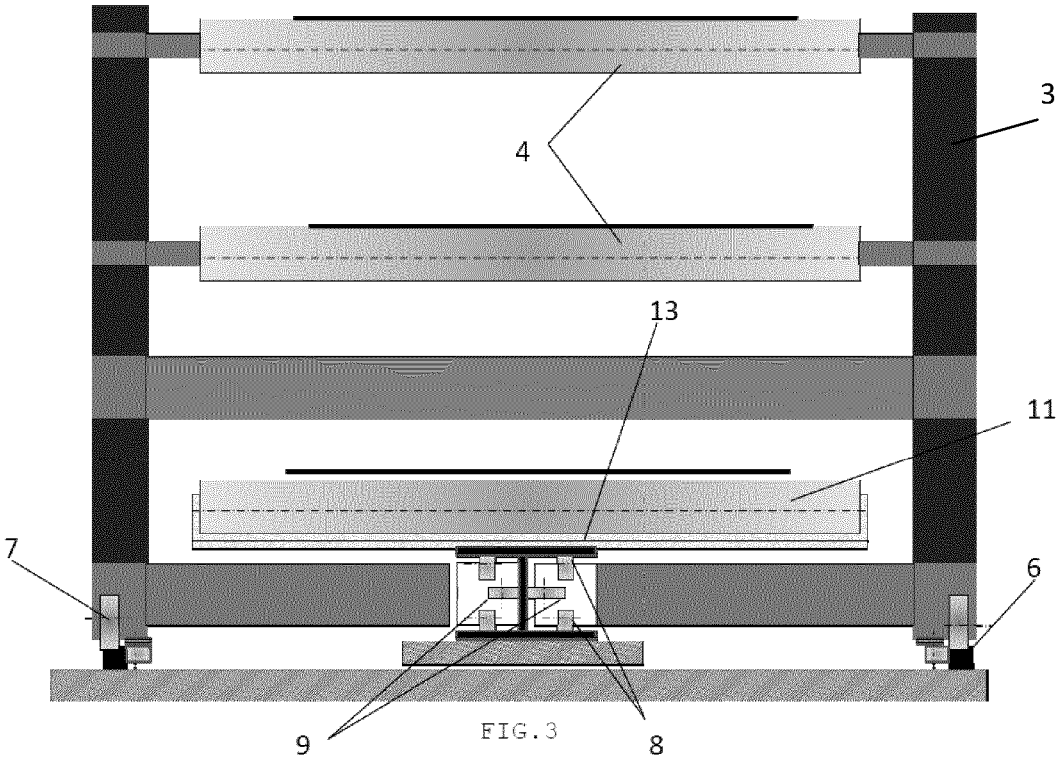
FIG. 3 represents a front view of the accumulator section depicted in FIG. 1.

As generally depicted on FIG. 1 to FIG. 3, the invention first consists in a series of strip supporting roll carriages 1, suitable for telescoping, according to a triangular design to allow a maximum telescoping effect. Each strip supporting carriage 1 has a triangular horizontal lower part 2 and a vertical framework 3, the latter provided with the strip supporting rolls 4 at different heights, according to the number of strip loops. The strip supporting roll carriages 1 ride on the same rails 6 as the looping carriage (the latter not represented), thanks to wheels 7 provided at the ends of the triangle basis 2 and the opposed front corner or apex 14 of the triangle 2 is guided within a central rail 13. The base 15 of the triangle is open at the bottom of the strip supporting carriage 1 in order to allow a telescoping of the triangle front corner 14 of the adjacent carriage 1. The telescoping of the strip supporting carriages takes thus place inside the internal void space limited by the open base 15 and the two other sides of the triangle, rejoining at the apex 14.

The triangle front corner 14 is also designed to be driven under the looping carriage. The triangle front corner 14 (towards the looping carriage) is guided during its ride within a girder or "I"-profile 13 to avoid tilting-over and misalignment of the supporting roll carriage 1. According to a preferred embodiment, four anti-tilting-over wheels, or cam rollers 8 are provided for horizontal rolling on the internal side of the flanges of the "I"-profile, one pair of wheels, or guiding cam rollers 9 are provided for rolling on each side of the web of the "I"-profile.

According to another embodiment of the invention, the guiding system is lodged underneath the stationary bottom strip supporting rolls 11 fixed on the girder or "I"-profile 13. The mobile strip supporting rolls 4 are arranged between the two vertical frameworks or profiles 3 on the carriage 1 upright above the lower triangle part of the carriage. As the triangle lower part is open at its basis, a necessary rigid link between the two other sides of the triangle is performed between these vertical profiles 3 at a height not hindering the strip loops.

Figure 4:
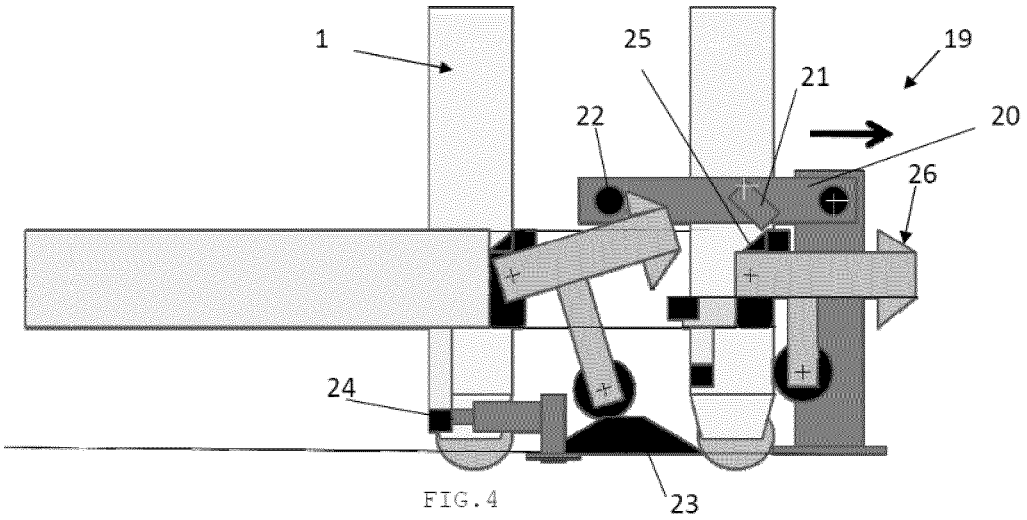
FIG. 4 represents schematically the unhooking and localisation system of the strip supporting carriages according to the present invention.
Figure 5:
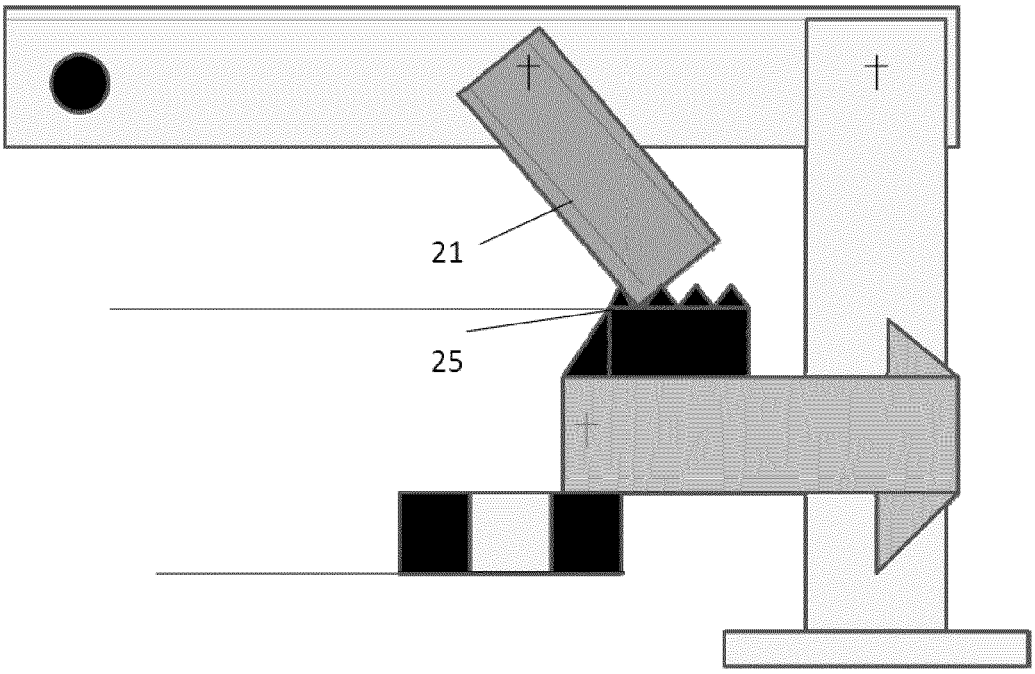
FIG. 5 represents in detail the lever and cam device of the unhooking system of FIG. 4.
Figure 6:
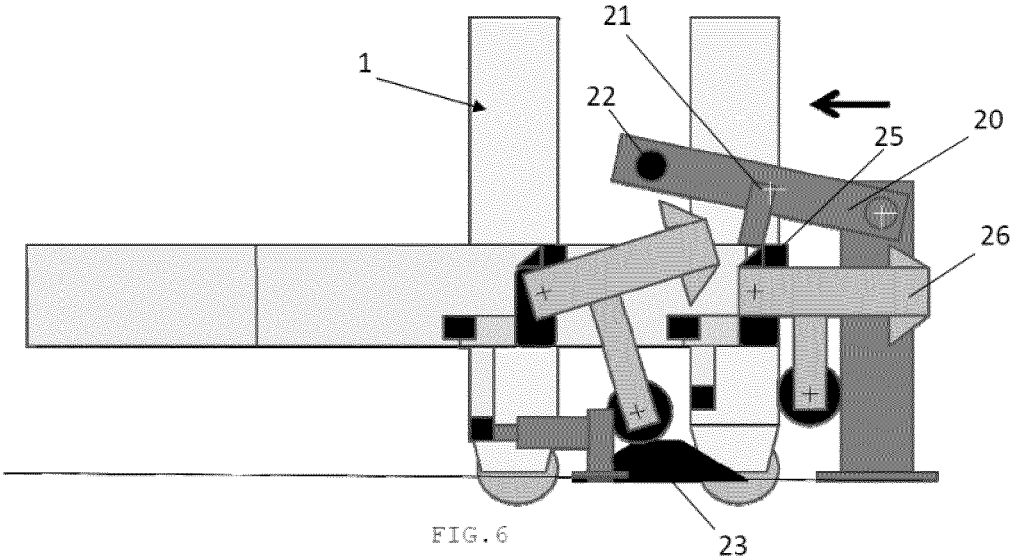
FIG. 6 represents schematically the unlocking mechanism with the system of FIG. 4.
Figure 7:
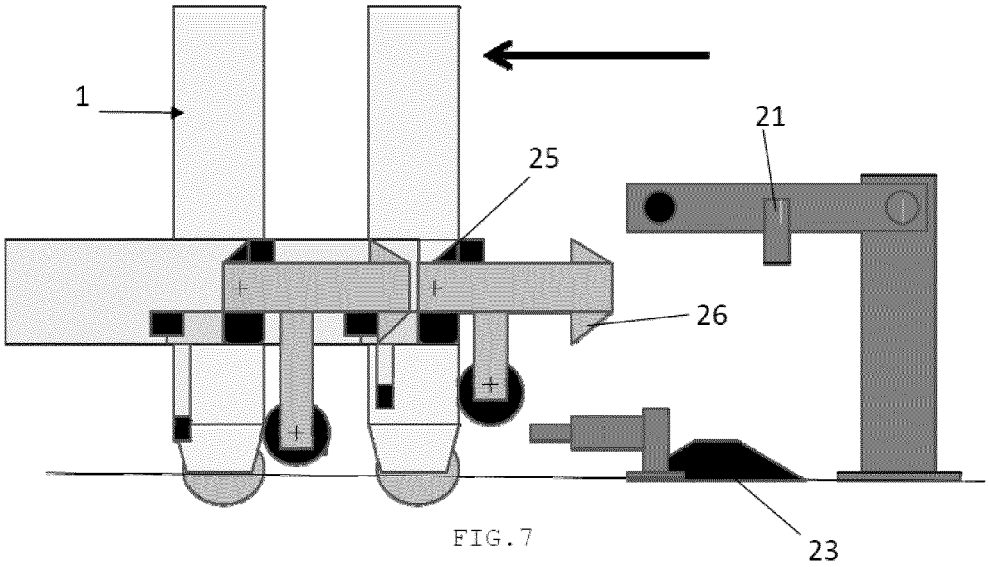
FIG. 7 represents schematically the hooking system of the strip supporting carriages according to the present invention.

Moreover the present invention uses passive elements including hooks and levers for automatically (un)hooking the supporting roll carriages 1 on (from) the looping car and the supporting roll carriages 1 between themselves, as represented on FIG. 4 to FIG. 7. A stationary cam system 23 at a certain ground location unhooks the carriage 1 at this required location, thanks to the stationary maintaining system 19 provided with a lever 21 and a lock 22, both integral with an arm 20, while the loops of the accumulator are enlarged and the looping car moves forwards (FIG. 4). The stationary locking system then hooks at its turn the just unhooked carriage 1, by means of the lock 22 located on the arm 20, so that it cannot ride backwards unless it is unlocked, i.e. further unhooked from its required location (FIG. 6). Stationary buffer 24 is able to reduce the shock possibly occurring when the forward ride of the carriage is stopped in its desired location. The stationary buffers should be placed at different heights, so that they only stop the right strip supporting 20 carriage and not the others. On the contrary, during loop diminishing and backwards ride of the looping carriage, the different strip supporting roll carriages 1 have to be collected and hooked again to the looping car as well as between themselves. When the carriages come back towards and onto an unhooked strip supporting roll carriage (located at its fixed desired location), a cam system 25, integral with the incoming carriage, raises the stationary lever 21, integral with arm 20 of the stationary maintaining system 19, which frees the backwards movement of the stopped strip supporting roll carriage 1 (FIG. 6). The arm 20 is progressively raised thanks to the serrated cam 25 cooperating with the lever 21 (FIG. 5), during the carriage backwards ride. The contact between the backwards driving carriage and the stopped carriage happens again via a buffer on the carriage 5 in order to reduce a possible shock. The stopped carriage is then hooked to the backwards moving carriage thanks to the gravity of its hook lever 26, falling in the hooking eye thereof (FIG. 7).

ADVANTAGES

The horizontal accumulator according to the invention is narrower than an accumulator according to prior art with strip supporting rolls, which have to be successively put into and out of line as mentioned above and is technically less demanding.

The invention combines simple system and length reduction as compared to other systems mentioned above and includes an anti-tilting-over system as well as a passive locating system for the strip supporting roll carriages. In particular, the reduction of accumulator capacity according to the invention is less than about 5%, due to the telescoping property of the strip supporting carriages. No additional structure is needed and there are less guiding wheels as compared with prior art. At last, the accumulator of the invention is suitable for processing heavy metal strips.

Only one central rail is necessary as compared to a second pair of rails mentioned above, the central rail cooperating with said anti-tilting-over system.

The invention thus combines the advantages of direct erection on flat ground and length reduction as compared to other systems mentioned above and includes an anti-tilting-over system. The passive locking mechanism is more prompt to avoid possible backwards movements of the strip supporting roll carriage during unhooking under severe conditions.

LIST OF REFERENCE NUMERALS

1 strip supporting carriage
2 horizontal triangular lower part of the strip supporting carriage
3 vertical framework of the strip supporting carriage
4 strip supporting roll
5 buffer of the strip supporting carriage
6 external rail
7 external wheel
8 anti-tilting-over wheel
9 guiding cam roller
10 strip
11 stationary roll
12 strip supporting rope
13 internal rail
14 apex or front corner of the triangular lower part
15 base of the triangular lower part
19 locking system of the strip supporting carriages
20 arm
21 lever
22 lock
23 stationary cam
24 stationary jack or buffer
25 freeing cam
26 hook

The invention claimed is:

1. A horizontal strip accumulator in a continuous processing strip line, comprising:

a looping carriage riding on a pair of external rails, which enlarges or diminishes strip loops in order to maintain a constant strip speed in a processing section, while an adjacent processing section runs for a certain time at a different speed;

a plurality of adjacent strip supporting roll carriages riding on the same external rails to support the strip between the looping carriage and a strip feeding location;

wherein each of the strip supporting carriages has a single horizontal triangular lower part and a vertical framework, the triangular lower part having an open transverse base of a triangle opposite to a single apex, to allow the telescoping of the plurality of strip supporting carriages in the internal triangular space between the open base and the two other triangular sides rejoining at the opposite apex; and wherein the apex of the triangular lower part is provided with means, comprising anti-tilting-over wheels and guiding cam rollers, for guided riding of each of the strip supporting carriage within a single internal rail, located between the two external rails.

2. The accumulator according to claim 1, wherein the internal rail is a "I"-profile or girder and the guided riding of each of the strip supporting carriages is arranged by means of four anti-tilting-over wheels rolling on an internal side of the flanges of the "I"-profile and two guiding cam rollers rolling on each side of a web of the "I"-profile.

3. The accumulator according to claim 1, wherein the vertical framework is provided with strip supporting rolls at different heights and with openings to allow the passage of the strip.

4. The accumulator according to claim 3, wherein the vertical framework is provided with buffers in order to soften the contact with an adjacent strip supporting carriage.

5. The accumulator according to claim 3, wherein the vertical framework comprises two vertical profiles connected by rigid link not hindering the strip loops.

6. The accumulator according to claim 1, wherein the triangular lower part is riding and guided underneath a plurality of stationary strip supporting rolls for the bottom strand of the strip.

7. The accumulator according to claim 6, wherein the stationary supporting rolls are fixed on the girder or "I"-profile.

8. The accumulator according to claim 1, further comprising passive means respectively for:

automatically and progressively unhooking the plurality of strip supporting carriages between themselves and from the forwards-moving looping carriage, when the loops are enlarged up to a maximum strip loop length corresponding to the sum of fixed inter-distances respectively between the looping carriage and its adjacent strip supporting carriage and between all the adjacent strip supporting carriages, the unhooked strip supporting carriages being stopped and locked at a determined location corresponding to said fixed inter-distances, by a stationary locking system;

automatically and progressively freeing the unhooked strip supporting carriages from their locked location when the loops are reduced and the looping carriage moving backwards, so that the loop length is lower than the maximum strip loop length;

automatically and progressively hooking the strip supporting carriages between themselves and to the looping carriage, after the strip supporting carriages have been progressively freed from their locked location.

9. The accumulator according to claim 8, wherein the passive means comprise:

a stationary cam for raising a hook of a strip supporting carriage from its hooking position on the adjacent strip supporting carriage or on the looping carriage; and a stationary locking system, comprising, integral with a same arm:

a lock to maintain the unhooked strip supporting carriage at said determined location;

a lever cooperating with a serrated cam on the strip supporting carriage, so that, when the looping carriage and possibly the already hooked strip supporting carriage thereto move backwards, the cam raises the lever and its corresponding arm, which suppresses the connection between the lock and the hook of the strip supporting carriage and frees the backwards movement of the formerly locked unhooked strip supporting carriage, the freed strip supporting carriage being able to hook to the incoming carriage in the backwards direction, due to the gravity putting the hook in a hook eye on the adjacent strip supporting carriage.

10. The accumulator according to claim 8, wherein the passive means comprise a stationary buffer or jack provided to soften the stop of the forwards moving strip supporting carriage at its determined locking location.

11. The accumulator according to claim 1, wherein the continuous strip processing line uses metal or textile or plastic strip.

* * * * *